United States Patent [19]

Hills

[11] 4,325,069

[45] Apr. 13, 1982

[54] CONVERTIBLE TELESCOPIC ANTENNA

[75] Inventor: Joseph F. Hills, Scottsdale, Ariz.

[73] Assignee: Jimmy's Radio & Televison Corp., Phoenix, Ariz.

[21] Appl. No.: 119,634

[22] Filed: Feb. 7, 1980

[51] Int. Cl.[3] ..... H01Q 1/10; H01Q 9/36

[52] U.S. Cl. ..... 343/750; 343/903

[58] Field of Search ..... 343/715, 749, 750, 900, 343/903

[56] References Cited

U.S. PATENT DOCUMENTS

| | | | |
|---|---|---|---|
| 3,104,394 | 9/1963 | Yokoyama | 343/750 |
| 3,172,109 | 3/1965 | Senrui | 343/749 |
| 3,798,654 | 3/1974 | Martino et al. | 343/750 |

FOREIGN PATENT DOCUMENTS

| | | | |
|---|---|---|---|
| 1238972 | 11/1964 | Fed. Rep. of Germany | 343/750 |

*Primary Examiner*—Eli Lieberman

*Attorney, Agent, or Firm*—Cahill, Sutton & Thomas

[57] ABSTRACT

A multisegment collapsible self-erecting AM/FM broadcast band power antenna for mobile receiving units includes a tip segment having a restrictor cooperating with a removable collar to limit the antenna extension to an optimum value for the AM/FM broadcast bands. Conversion of the antenna to a length and load impedance commensurate with reception of signals in the AM/FM broadcast bands and transmission/reception in the CB band is effected by replacement of the collar with a loading coil module together with extension of the lower end of the tip segment into the loading coil module and out of physical connection with the adjacent segment. Normal extension and collapse of the antenna remains unaffected and the conversion is reversible.

8 Claims, 6 Drawing Figures

CONVERTIBLE TELESCOPIC ANTENNA

The present invention relates to antennas and, more particularly, to antennas convertible for use in multiple frequency bands.

Many years ago various manufacturers began manufacturing and selling collapsible self-erecting power antennas for automobiles to avoid the unsightliness of an antenna and to foil vandals from breaking off the antennas. These antennas include a base unit mountable interior of the fender of a vehicle, which base unit houses the collapsed segments of the antenna and is attachable, through a cable, to an electric motor drive mechanism for raising and lowering the antenna in response to actuation of a switch. These antennas, in combination with the electrical coupling devices disposed intermediate the antenna lead and the radio receiver, are relatively expensive to buy and incur substantial installation costs.

With the recent advent of pronounced interest by motorists to incorporate a CB communication system in their vehicles, several problems have arisen. There exist commercially available collapsible self-erecting power antennas which are useable for receiving signals in the AM/FM broadcast bands and for transmitting/receiving signals in the CB band, provided appropriate signal splitters and other coupling devices are employed. However, the cost of replacing existing antennas with such three band antennas is very substantial. To avoid these substantial costs, the motorist has no alternative but to install an externally mounted antenna for his CB communication system and accept the consequences of such a mounting.

It is therefore a primary object of the present invention to provide a collapsible self-erecting power antenna for the AM/FM broadcast bands which is convertible to an antenna also useable with a CB band two-way communications unit.

Another object of the present invention is to provide an AM/FM broadcast band antenna which is inexpensively convertible into an antenna also useable with a citizens band two-way communications unit.

Still another object of the present invention is to provide a tip segment of a multi-segmented collapsible self-erecting antenna which is physically and electrically alterable to render the antenna electrically compatible with a citizens band two-way communications unit as well as an AM/FM broadcast band receiver.

A further object of the present invention is to provide a means for converting the physical and electrical parameters of a collapsible antenna to be compatible with communication in the AM/FM broadcast bands and the CB band.

A yet further object of the present invention is to provide a conventional collapsible self-erecting AM/FM broadcast band power antenna with an inexpensive conversion feature to render the antenna also compatible with transmission and reception in the CB band.

A still further object of the present invention is to provide a selectively extendable tip segment of a multi-segmented collapsible antenna and a loading coil to convert the physical and electrical characteristics of the antenna.

These and other objects of the present invention will become apparent to those skilled in the art as the description thereof proceeds.

The present invention may be described with greater specificity and clarity with reference to the following drawings, in which.

Figure 1:
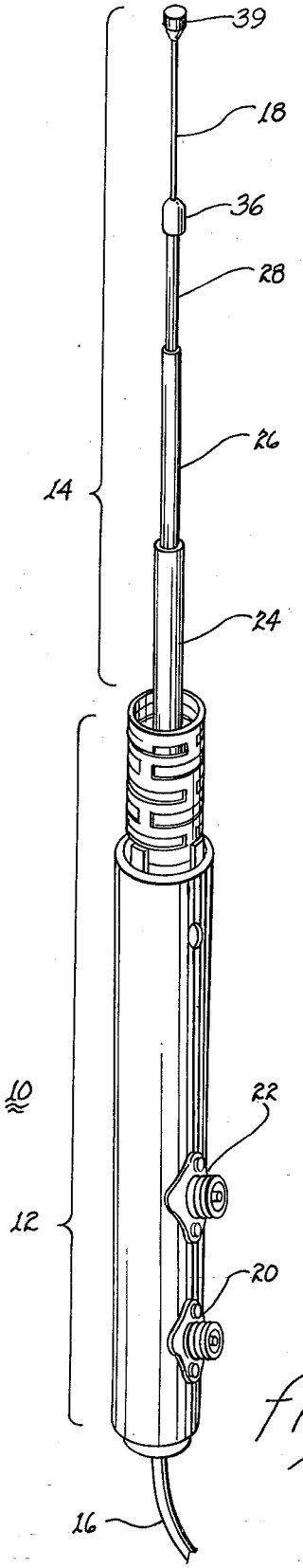
FIG. 1 illustrates a conventional collapsible self-erecting antenna unit to be modified in accordance with the teachings of the present invention.
Figure 2:
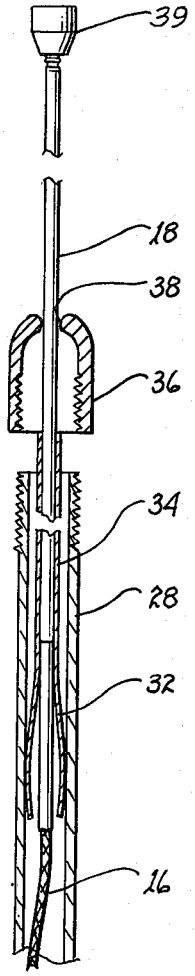
FIG. 2 is a cross-sectional view of a part of the antenna illustrated in FIG. 1.

Referring to FIGS. 1 and 2 there is illustrated a collapsible self-erecting antenna unit 10. The unit includes a base section 12 and a segmented collapsible antenna 14. A cable 16 extends from the base section and interconnects top most segment 18 of antenna 14 with a spool or similar device attached to an electric motor. Energization of the electric motor will either extend or retract cable 16 from within base section 12 and produce a corresponding extension or retraction of antenna 14 from base section 12. Studs 20 and 22 are disposed upon base section 12 and electrically connect with antenna 14. Coaxial cables interconnect the studs, either directly or through a signal splitter, with a receiver or a transceiver.

Antenna unit 10 is normally mounted in the fender or at the side of an automobile with the base section being buried interior of the vehicle such that the tip of antenna 14, when collapsed, is flush with mounting hardware supporting base section 12 in a depending relationship. Thereby, when antenna 14 is collapsed, damage thereto by vandalism is essentially precluded. Yet, the antenna can be extended at will be energizing the electric motor attached to the end of cable 16. The cable is of electrically non-conducting material and may be a flexible rod of plastic or other like material; for reasons of simplicity in terminology, the term "cable" is used hereafter.

Antennas of the type illustrated in FIGS. 1 and 2 physically and electrically configured to receive radio transmission signals from AM and FM broadcast stations. Were such an antenna used in conjunction with a two-way communications system operating in the CB band, reception and transmission would be severaly impaired. Thus, both the physical and electrical characteristics of antenna 14 would have to be modified to provide an adequate radiation pattern for use in the CB band.

Referring jointly to FIGS. 3, 4, 5 and 6, there will be described apparatus for modifying antenna 14 to be compatible with the reception of radio transmission in the AM and FM broadcast bands and serve as an effective antenna for two-way communication in the CB band.

Segments 24, 26, 28 and 18 (see FIG. 1) are telescopically interconnected to provide a length when antenna 14 is extended which is compatible with reception of radio transmissions in the AM and FM broadcast bands. This length, however, is less than optimum for radio reception and transmission in the CB band. To convert antenna unit 10 into an antenna useable in any of the AM broadcast band, the FM broadcast band or the CB band, the physical length of antenna 14 is increased by modifying segment 18 to permit further extension thereof. To establish an acceptable standing wave ratio, or impedance matching, a loading coil module 30, as illustrated in FIGS. 3 and 4 is attached to antenna 14.

The structural features of an AM/FM broadcast band antenna unit 10 into an antenna unit compatible with the AM broadcast band, the FM broadcast band and the CB band are primarily illustrated in FIGS. 1 and 2. Cable 16 extends from the lower end of segment 18 whereby translation of the cable will cause antenna 14 to either extend or retract, as is well known to those skilled in the art. A plurality of spring fingers 32 are disposed about the lower end of segment 18 to establish and maintain good electrical contact with segment 28 as segment 18 is displaced along segment 28. An electrically insulating sleeve 34 extends upwardly along segment 18 from fingers 32. This sleeve serves one function of fine tuning the antenna for reception in the FM broadcast band. An apertured threaded cap 36 threadedly engages the upper end of segment 28 and includes aperture 38 through which segment 18 is slidable. The diameter of aperture 38 is sufficient to let segment 18 pass therethrough but the aperture will interferingly contact sleeve 34. Thereby, the sleeve has a second function of limiting the extension of segment 18 with respect to segment 28. By this structure, the extended length of antenna 14 is maintained compatible with that required for reception of radio signals in the AM or FM broadcast bands.

Figure 3:
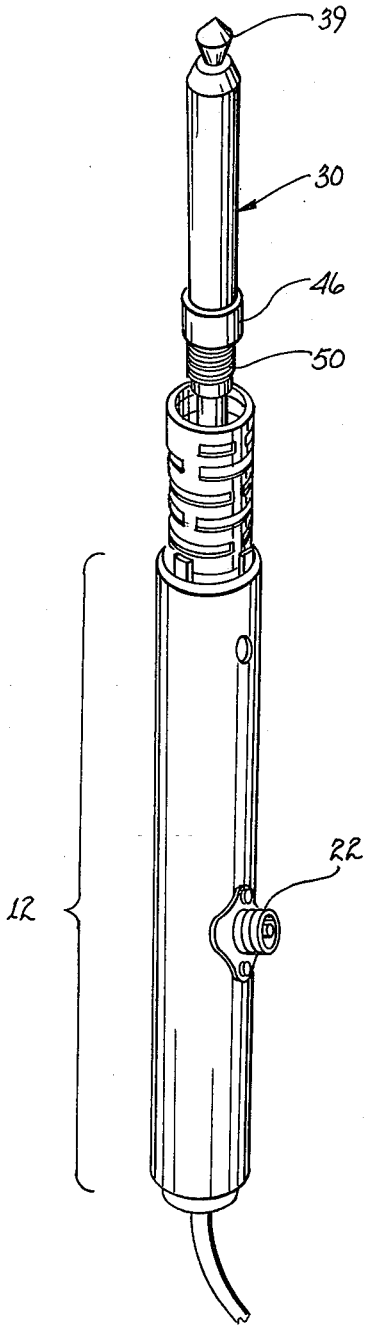
FIG. 3 illustrates a structural and electrically modified embodiment of the antenna illustrated in FIG. 1.
Figure 5:
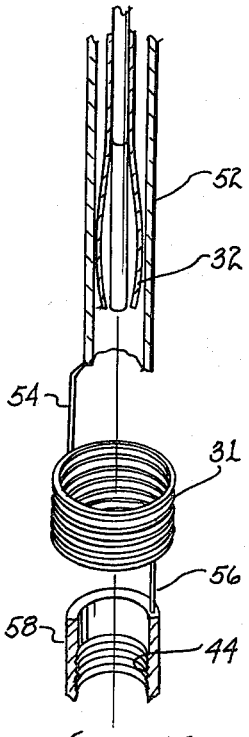
FIGS. 5 and 6 illustrate details of the loading coil module.

To convert the antenna illustrated in FIG. 1 to an antenna suitable for use also in the CB band, as illustrated in FIG. 3 the following modifications are made. A button 39, physically mounted at the tip of segment 18 to reduce the possibility of corona discharge, is unthreaded and removed. Cap 36 is unthreaded and is slidably removed from segment 18. Loading coil module 30 is slid onto segment 18 and is threadedly attached to segment 28. Button 39 is rethreaded onto the tip of segment 18.

Figure 4:
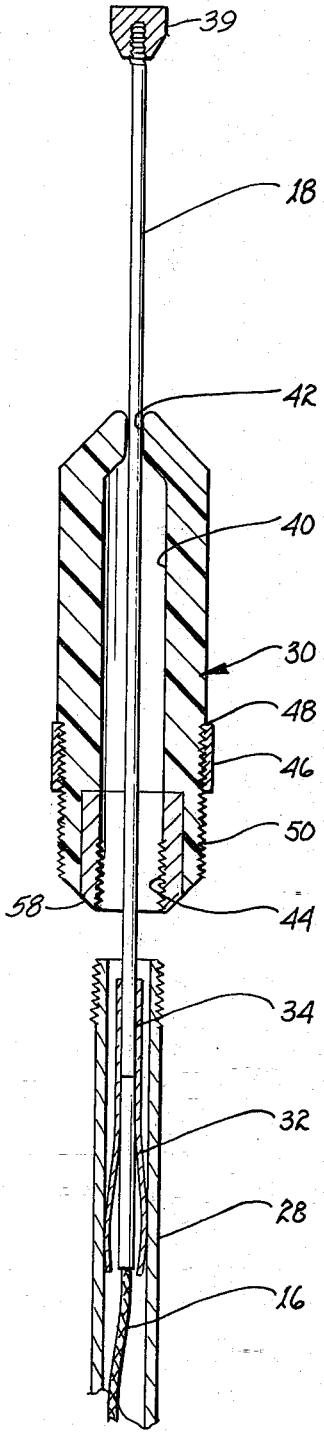
FIG. 4 illustrates a generalized view of the structure of the loading coil module.
Figure 6:
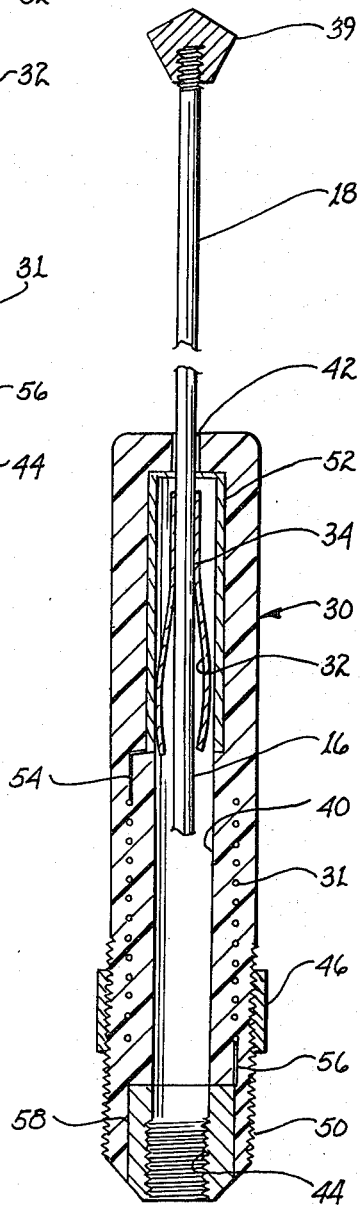

As will be noted from examination of FIGS. 4 and 6 the loading coil module includes an interior cavity 40 of sufficient diameter so as not to interferingly contact either sleeve 34 or fingers 32. However, opening 42 closely conforms to the diameter of segment 18 to allow the unsleeved part of the segment to pass therethrough but interfere with sleeve 34. Thereby, on extension of segment 18 through translation of cable 16, segment 18 will be extended until sleeve 34 interferingly contacts opening 42. During retraction of the antenna segment 18 is readily drawn into segment 28 by the guidance provided through radially inwardly turned ends of fingers 34. Retraction of segment 28 into segment 26 is accomplished by button 39 pushing downwardly against the loading coil module. This process is repeated until all the segments are collapsed within the base unit.

Internal cavity 40 supports at one end an electrically conductive cylinder 52 for receiving and making good electrical contact with spring fingers 32 when segment 18 is fully extended. The length of cavity 40 is greater than the combined length of sleeve 34 and fingers 32 to free the lower end of segment 18 from segment 28. One end of loading coil 31 is electrically connected to cylinder 52 through electrical conductor 54. The other end of the loading coil is electrically connected by electrical conductor 56 with an electrically conductive insert 58 having threads 44 which threadedly engages the upper end of segment 28 (see FIG. 4). Thereby, an electrically conductive path is established from segment 28 via insert 58, conductor 102, loading coil 31, conductor 54, cylinder 52 to spring fingers 32.

As illustrated, a metallic band 46 is disposed about loading coil 31 and positioned longitudinally therealong for fine tuning of the antenna. The longitudinal repositioning may be effected by turning the band with respect to the coil whereby threads 48 interior of the band threadedly engage external threads 50 at the lower end of the loading coil.

It may be noted that the reception in the AM and FM broadcast bands is not noticeably negatively effected by the above described conversion.

Along with the above described conversion of antenna 14, modification of the number of studs 20, 22 may be made. In the alternative, various signal splitter devices may be attached to the appropriate ones of the studs to interconnect the antenna with the respective one of the AM, FM or CB units, as is well known to those skilled in the art.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A method for converting a power driven cable actuated retractable multi-segment AM/FM broadcast band antenna to an antenna for use with AM/FM broadcast band receivers and a citizens band two-way communications unit, which antenna prior to conversion includes a top segment attached to an end of the cable which top segment draws out the remaining segments on extension of the cable and nests the remaining segments on retraction of the cable, a cap attached to an adjacent segment for precluding disengagement of the top segment from the adjacent segment on extension of the cable while accommodating nesting of the segments in response to the cable induced force exerted by a tip element secured to the free end of the top segment bearing against the cap on retraction of the cable, said method comprising the steps of:

(a) removing the cap from the adjacent segment;
(b) disengaging the tip element from the top segment;
(c) penetrably mounting a loading coil for altering the electrical parameters of the antenna upon the top segment, which loading coil includes a passageway extending therethrough and having one end of sufficient diameter to receive an end portion of the adjacent segment and another end of a size sufficient to interfere with translation of the cable through the passageway on extension of the cable and of the tip element into the passageway on retraction of the cable;
(d) attaching the loading coil upon the upper end of the adjacent segment in substitution of the cap; and
(e) re-engaging the tip element to the top segment to form a shoulder bearing against the loading coil to cause nesting of the segments on retraction of the cable.

2. The method as set forth in claim 1 wherein said step of attaching comprises the step of threadedly attaching the loading coil to the adjacent segment.

3. The method as set forth in claim 2 wherein said step of re-engaging includes the steps of threading the tip element to the top segment.

4. The method as set forth in claim 3 wherein said step of removing comprises the step of unthreading the cap from the adjacent segment.

5. Apparatus for converting a power driven cable actuated retractable multi-segment AM/FM broadcast band antenna to an antenna for use with AM/FM broadcast band receivers and a citizens band two-way communications unit, which antenna prior to conversion includes a top segment attached to an end of the cable to draw out the remaining segments on extension of the cable and to nest the remaining segments on retraction of the cable, a cap attached to an adjacent segment for precluding disengagement of the top segment from the adjacent segment on extension of the cable while accommodating nesting of the segments in response to the cable induced force exerted by a tip element secured to the free end of the top segment bearing against the cap, said apparatus comprising in combination:

(a) a loading coil for altering the electrical parameters of the antenna;

(b) said loading coil including:

(1) a passageway for translatory movement of the top segment therein;

(2) one end of said passaeway including means for attaching said loading coil upon the adjacent segment in place of the cap;

(3) another end of said passageway including means for translatorily receiving the top segment while inhibiting passage therethrough of the adjacent section; and (4) means for interferingly engaging the tip element on retraction of the cable and resulting in nesting of the segments;

whereby, the force exerted by the cable during extension and retraction acts through said loading coil to extend and retract the segments of the antenna while providing an altered electrical parameter to the antenna.

6. The apparatus as set forth in claim 5 wherein said attaching means comprises thread means for engaging the adjacent section.

7. The apparatus as set forth in claim 5 wherein:

(a) said attaching means comprises an electrically conductive insert;

(b) said receiving means comprises an electrically conductive cylinder; and (c) said loading coil module includes:

i. a loading coil; and ii. means for electrically connecting said loading coil intermediate said insert and said cylinder.

8. The apparatus as set forth in claim 7 wherein said loading coil includes a repositionable band for tuning said loading coil.

* * * * *